US008925457B2

(12) United States Patent
Latzel et al.

(10) Patent No.: US 8,925,457 B2
(45) Date of Patent: Jan. 6, 2015

(54) PRINTING FORM

(75) Inventors: Harald Latzel, Heidelberg (DE); Ralf Niggemann, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 183 days.

(21) Appl. No.: 13/572,849

(22) Filed: Aug. 13, 2012

(65) Prior Publication Data

US 2013/0036926 A1 Feb. 14, 2013

(30) Foreign Application Priority Data

Aug. 11, 2011 (DE) ..... 10 2011 110 014

(51) Int. Cl.
*B41N 1/00* (2006.01)
*B41C 1/10* (2006.01)
*B41C 1/18* (2006.01)

(52) U.S. Cl.
CPC ..... *B41C 1/1016* (2013.01); *B41C 2201/10* (2013.01); *B41C 1/18* (2013.01); *B41C 2210/20* (2013.01); *B41C 2201/04* (2013.01); *B41C 2201/02* (2013.01)
USPC ..... 101/401.1; 101/368; 101/463.1; 430/302

(58) Field of Classification Search
CPC ..... B41N 1/006; B41N 1/00; B41N 1/22
USPC ..... 101/368
See application file for complete search history.

(56) References Cited

U.S. PATENT DOCUMENTS

| | | | | |
|---|---|---|---|---|
| 6,024,019 | A * | 2/2000 | Williams et al. | 101/463.1 |
| 6,210,845 | B1 * | 4/2001 | Hotta et al. | 101/467 |
| 6,534,240 | B1 * | 3/2003 | Hoshi | 101/456 |
| 7,152,530 | B2 * | 12/2006 | Schmohl et al. | 101/467 |
| 7,205,091 | B2 * | 4/2007 | Cassidy | 430/272.1 |
| 7,704,590 | B2 | 4/2010 | Vosseler et al. | |
| 7,781,156 | B2 * | 8/2010 | Yoo et al. | 430/325 |
| 2005/0263022 | A1 | 12/2005 | Cassidy | |
| 2006/0234162 | A1 | 10/2006 | Rondon | |
| 2007/0231740 | A1 | 10/2007 | Yanaka et al. | |
| 2009/0035703 | A1 | 2/2009 | Mennig et al. | |
| 2009/0050007 | A1 * | 2/2009 | Fujioka et al. | 101/395 |

FOREIGN PATENT DOCUMENTS

| | | | |
|---|---|---|---|
| DE | 102004007600 | A1 | 9/2005 |
| DE | 102005023871 | A1 | 11/2006 |
| JP | 2001130154 | A | 5/2001 |

* cited by examiner

*Primary Examiner* — Jill Culler
(74) *Attorney, Agent, or Firm* — Laurence A. Greenberg; Werner H. Stemer; Ralph E. Locher

(57) ABSTRACT

A printing form includes a bonding layer, an intermediate layer and a top layer. The top layer includes silicon nitride.

12 Claims, 1 Drawing Sheet

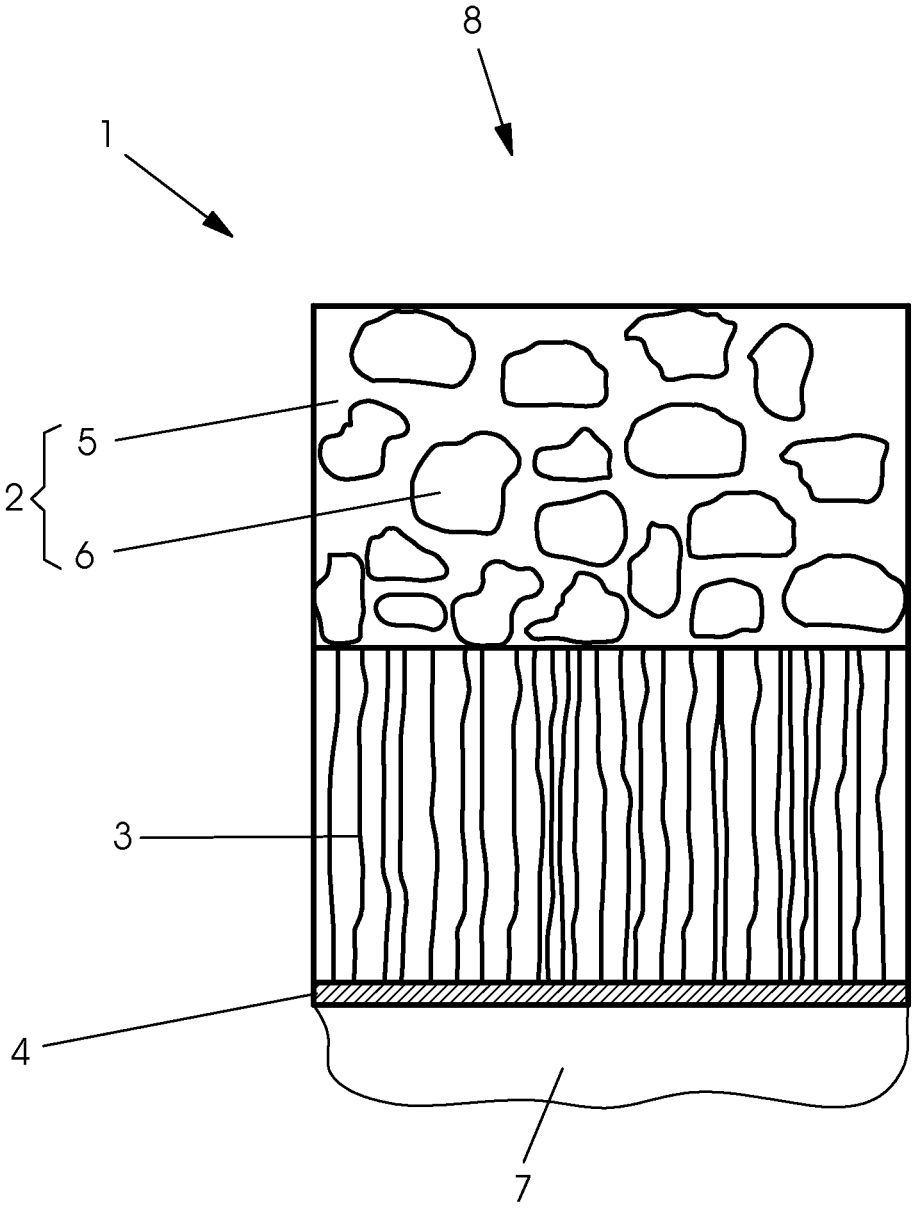
8
1
5
2
6
3
4
7

PRINTING FORM

CROSS-REFERENCE TO RELATED APPLICATION

This application claims the priority, under 35 U.S.C. §119, of German Patent Application DE 10 2011 110 014.1, filed Aug. 11, 2011; the prior application is herewith incorporated by reference in its entirety.

BACKGROUND OF THE INVENTION

Field of the Invention

The present invention relates to a printing form.

In planographic printing, printing forms are used which are formed of layers disposed one above another. The layers have various tasks, e.g. thermal insulation and absorption of radiation during imaging. The printing forms are imaged by energy which is introduced in accordance with image information, e.g. through the use of a laser. The surface of the printing forms is thereby structured into hydrophilic (oleophobic) and hydrophobic (oleophilic) regions.

One problem is that the energy absorption of the absorption layer is limited by a temperature at which the layer could be damaged or destroyed.

In order to solve that problem, German Patent Application DE 10 2004 007 600 A1, corresponding to U.S. Pat. No. 7,704,590, proposes printing forms with a specific layer structure. The aim of the layer structure is to minimize the radiation energy which is required for the imaging. The layer structure includes a top or information layer of titanium dioxide, an absorption layer of titanium or molybdenum and of carbon, nitrogen and oxygen. Furthermore, it includes a buffer layer of titanium or molybdenum, an insulation layer of polyimide and a carrier layer of aluminum.

One disadvantage thereof is that the layer formed of titanium or titanium dioxide is not adequately stable. The layer changes upon repeated imaging, which in particular is associated with a change in the absorption properties. After a plurality of imaging and printing cycles, parts of earlier printed images, so-called "memories," can be seen as interference effects.

SUMMARY OF THE INVENTION

It is accordingly an object of the invention to provide a printing form, which overcomes the hereinafore-mentioned disadvantages of the heretofore-known devices of this general type and which is more suitable for repeated re-imaging of the printing form.

With the foregoing and other objects in view there is provided, in accordance with the invention, a printing form, comprising a bonding layer, an intermediate layer and a top layer including silicon nitride.

This printing form has favorable characteristics for the repeated imaging thereof.

In accordance with another feature of the invention, the top layer is nanostructured.

In accordance with a further feature of the invention, grains of another nitride are embedded in the silicon nitride.

In accordance with an added feature of the invention, the grains have a maximum outer dimension in a range of 3 nm to 10 nm.

In accordance with an additional feature of the invention, the top layer includes titanium aluminum nitride.

In accordance with yet another feature of the invention, the top layer includes aluminum chromium nitride.

In accordance with yet a further feature of the invention, the intermediate layer has a columnar structure.

In accordance with yet an added feature of the invention, the intermediate layer includes titanium aluminum nitride.

In accordance with yet an additional feature of the invention, the bonding layer includes titanium nitride.

In accordance with a concomitant feature of the invention, the bonding layer includes titanium chromium nitride, titanium-titanium nitride or chromium-chromium nitride.

The printing form of the invention includes a carrier which is a printing plate or a printing plate cylinder or is formed on a printing plate or a printing plate cylinder of a printing press.

Other features which are considered as characteristic for the invention are set forth in the appended claims.

Although the invention is illustrated and described herein as embodied in a printing form, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE SINGLE VIEW OF THE DRAWING

The FIGURE of the drawing is a diagrammatic, cross-sectional view of a printing form.

DETAILED DESCRIPTION OF THE INVENTION

Referring now in detail to the single FIGURE of the drawing, there is seen a sectional view of a printing form 1 to be applied to a printing cylinder of a printing press 8 for planographic or lithographic printing. The printing form 1 includes a top layer 2, an intermediate layer 3 and a bonding layer 4. A layer of amphiphilic molecules, which is applied to the top layer 2, is not shown. During imaging, the amphiphilic molecules are locally removed by heating through the use of a laser in accordance with image information. Then, the exposed top layer 2 and the amphiphilic molecules which have remained form hydrophobic (oleophilic) printing regions and hydrophilic (oleophobic) non-printing regions of the printing form 1. The printing regions accept printing ink and the non-printing regions accept dampening solution. The top layer 2 is therefore an information layer which determines image information of the printing form 1.

The top layer 2 has a thickness of 0.5 μm to 5.0 μm, preferably of 0.5 μm to 1.5 μm, and is a nanostructured layer. The top layer 2 has an amorphous matrix 5 of silicon nitride ($Si_3N_4$) and grains 6 of titanium aluminum nitride (TiAlN or AlTiN) or aluminum chromium nitride (AlCrN) embedded therein. Titanium aluminum nitride is also referred to as aluminum titanium nitride given a percentage ratio Al/Ti>1. The matrix 5 has a structure size of 1 nm to 3 nm and the size of the nanocrystalline grains 6 is 3 nm to 10 nm. The variant with titanium aluminum nitride is preferred and ensures an extreme heat resistance, oxidation resistance, insensitivity to cracking and little reflection (good absorption).

The intermediate layer 3, which forms the middle layer in the preferred S-layer system shown, has a thickness in a range of 0 to 4.5 μm, preferably of 2 μm to 3.5 μm. A thickness of "zero" means that the intermediate layer 3 is not present in that case. The intermediate layer 3 can be formed of yttrium-stabilized zirconium oxide, aluminum chromium nitride (AlCrN) or of aluminum titanium chromium nitride (AlTiCrN). Preference is given to an intermediate layer 3 which is formed of titanium aluminum nitride (TiAlN or AlTiN) and differs by virtue of the columnar material structure thereof from the top layer 2 which is formed of the granular titanium aluminum nitride. The intermediate layer 3 including TiAlN or AlTiN is very tough and has layer structures with a poor thermal conductivity, i.e. it is a good thermal insulator.

The bonding layer 4 serves to bond the 3-layer system shown to a carrier layer 7, which likewise forms part of the printing form 1. The carrier layer may be formed on, or be formed of, a plate which is formed, for example, of aluminum, high-grade steel or titanium, a sleeve or a strip. The carrier layer can also form the circumferential surface of a cylinder, to which the bonding layer 4 adheres. The bonding layer 4 has a thickness of 0.10 μm to 0.25 μm and preferably approximately 0.2 μm and is formed of titanium nitride (TiN), e.g. of a titanium-titanium nitride (Ti—TiN) gradient layer or of a chromium-chromium nitride (Cr—CrN) gradient layer or of titanium chromium nitride (TiCrN). Preference is given to TiN. The 3-layer system formed of the top layer 2, the intermediate layer 3 and the bonding layer 4 can be obtained, for example, under the trade name "Sistral®" from Eifeler Süd-Coating GmbH in Ettlingen, Germany. That company usually uses the 3-layer system to coat machining tools, e.g. drills, i.e. objects which are extraneous to the invention. It is possible to produce the printing form 1 by coating the carrier layer which is formed, for example, as an aluminum plate, of the printing form 1 with the 3-layer system ("Sistral®"). The top layer 2, the intermediate layer 3 and the bonding layer 4 can be applied by physical vapor deposition (PVD), in particular arc evaporation (arc PVD).

The printing form 1 according to the invention is able to withstand high temperatures of up to 1000° C.

Modifications may include dividing or splitting the top layer 2 into a plurality of such layers and/or the intermediate layer 3 into a plurality of such layers.

Furthermore, it is conceivable to cover the top layer 2 with a further layer, so that the top layer 2 is no longer a top layer. The further layer may include one or more metals, metal nitrides, metal oxides or metal oxynitrides.

Yet another modification is that one or more of the sublayers (top layer 2, intermediate layer 3, bonding layer 4) are graduated, i.e. they have a stepped or continuous variation of the percentage of microstructure constituents thereof.

The invention claimed is:

1. A printing form, comprising:
a bonding layer;
an intermediate layer having a columnar structure; and
a top layer including silicon nitride.

2. The printing form according to claim 1, wherein said top layer is nanostructured.

3. The printing form according to claim 1, which further comprises grains of another nitride embedded in said silicon nitride.

4. The printing form according to claim 3, wherein said grains have a maximum outer dimension in a range of 3 nm to 10 nm.

5. The printing form according to claim 3, wherein said top layer includes titanium aluminum nitride or aluminum titanium nitride in said grains.

6. The printing form according to claim 1, wherein said top layer includes aluminum chromium nitride.

7. The printing form according to claim 1, wherein said intermediate layer includes titanium aluminum nitride or aluminum titanium nitride.

8. The printing form according to claim 1, wherein said intermediate layer includes yttrium-stabilized zirconium oxide, aluminum chromium nitride or aluminum titanium chromium nitride.

9. The printing form according to claim 1, wherein said bonding layer includes titanium nitride.

10. The printing form according to claim 1, wherein said bonding layer includes titanium chromium nitride, titanium-titanium nitride or chromium-chromium nitride.

11. A printing form, comprising:
a carrier being a printing plate or a printing plate cylinder or being formed on a printing plate or a printing plate cylinder;
a bonding layer bonded on said carrier;
an intermediate layer disposed on said bonding layer and having a columnar structure; and
a top layer disposed on said intermediate layer and including silicon nitride.

12. A printing press, comprising:
a printing form according to claim 1.

* * * * *